US005278740A

United States Patent [19]

Agnelli

[11] Patent Number: 5,278,740

[45] Date of Patent: Jan. 11, 1994

[54] UTILITY LAMP

[76] Inventor: Albert V. Agnelli, 40 Beverley Street, Toronto, Ontario M5T 1X9, Canada

[21] Appl. No.: 824,610

[22] Filed: Jan. 23, 1992

[51] Int. Cl.[5] ..... F21V 71/00

[52] U.S. Cl. ..... 362/226; 362/376; 362/382

[58] Field of Search ..... 362/190, 191, 226, 376, 362/377, 378, 382, 398; 108/125, 129

[56] References Cited

U.S. PATENT DOCUMENTS

| | | | |
|---|---|---|---|
| 2,580,359 | 12/1951 | Moineau . | |
| 2,710,338 | 6/1955 | Svalgaard | 362/186 |
| 2,760,837 | 8/1956 | Wade | 108/129 |
| 2,905,513 | 9/1959 | Kane | 108/129 |
| 3,177,358 | 4/1965 | Suttie | 362/376 |
| 4,236,195 | 11/1980 | Kovacik . | |
| 4,369,487 | 1/1983 | Carlow | 362/398 |
| 4,535,395 | 8/1985 | Prester | 362/398 |
| 4,562,521 | 12/1985 | Noguchi . | |
| 4,723,823 | 2/1988 | Pinkerton et al. . | |

*Primary Examiner*—Richard R. Cole

*Attorney, Agent, or Firm*—Woodcock Washburn Kurtz Mackiewicz & Norris

[57] ABSTRACT

A modular utility lamp, commonly known as a trouble light, which includes a handle with a socket on one end and electric prongs for connecting an extension cord to the other end, and a protective cage for surrounding and protecting an electric bulb in the socket. The protective cage preferably includes two identical halves which twist-lock together to facilitate replacement of the bulb. A freely rotatable hook with a twist-lock base is provided for the top end of the protective cage. The utility lamp is also provided with a collapsible base for supporting the lamp in an upright position above a work area. The lamp, including the base, are carefully proportioned and designed to provide a utility lamp with asthetic appeal which may be used in environments where prior art lamps of the same type were considered inappropriate.

18 Claims, 3 Drawing Sheets

UTILITY LAMP

The present invention relates to lighting devices and, in particular, to a novel utility lamp having a modular construction.

BACKGROUND OF THE INVENTION

Utility lamps, commonly referred to as trouble lights, are widely known and used by persons such as mechanics, electricians, communications, heating, ventilation, air-conditioning and other service persons, who require a relatively portable light source. Such lamp generally comprise a handle having a socket on one end and an extension cord permanently affixed to the other end of the handle. The socket end of the lamp usually further includes a cage which surrounds and protects a light bulb in the socket. Although such lamps normally function well for an extended period of time, they suffer from certain drawbacks which detract from their appeal.

First, the extension cord of most utility lamps is molded into the handle and forms an integral part thereof. Because the extension cord is the part of the utility lamp most subject to wear, it usually deteriorates to an unsafe or nonfunctional condition while the handle, the switch and the cage of the lamp are still in working condition. As a result, the entire lamp must be discarded even though the lamp itself is in good working order.

Second, the integral extension cord of known utility lamps is of a fixed length. The cord is therefore frequently much longer than required or too short to satisfactorily accomplish a given task. In the first instance, unused coils of cord clutter a work area which contributes to the wear on the cord and presents a safety hazard. In the second instance, a second extension cord must be used which introduces a connection in the cord that is potentially hazardous in wet conditions.

Third, the integral construction of known utility lamps is uneconomical because an extension cord must be dedicated to the solitary function of servicing the lamp and cannot be used for other purposes, and is awkward to store.

Fourth, known utility lamps commonly include a hook affixed to the top of the cage so that the lamp may be suspended from a support surface. Such lamps do not, however, provide any other means for supporting the lamp in the vicinity of a work area to be illuminated. It is often desirable to support a lamp in an upright orientation in an area where no support is available for attaching the hook of the common utility lamp. In such conditions, the lamp must be supported by hand or laid flat on the work area, neither of which are satisfactory.

Finally, utility lamps are generally not designed with a view toward asthetic appeal. They have therefore been relegated to service in working environments such as garages and the like because they are not of a design standard which can achieve a broad public acceptance.

Utility lamps appear to be such a common and accepted tool that little inventive ingenuity has been directed toward their improvement. U.S. Pat. No. 2,580,359 to Moineau describes a portable electric lamp guard having a pivoted door to provide access to an interior of the guard for servicing an electric bulb in the lamp. U.S. Pat. No. 4,236,195 to Kovacik describes a guard for a utility lamp comprising a reflector section and a cage section which are preferably molded from a nonconducting synthetic resin.

Other art which is not directly related to the invention but considered to be of potential relevance includes U.S. Pat. No. 4,723,823 to Pinkerton et al. which describes a night light that plugs directly into a socket and includes a protective shield for covering a low power electric bulb. U.S. Pat. No. 4,562,521 to Noguchi describes a lamp stand adapted to support an oriental lantern in a fully expanded state.

In view of the prior art listed above it is apparent that there exists a longstanding need for an improved, versatile, asthetically pleasing utility lamp which is adapted for use to provide hands free illumination of practically any work area.

SUMMARY OF THE INVENTION

The present invention to provide a utility lamp which does not include an integral extension cord so that the service life of the lamp is not dependent on the extension cord and a suitable length of cord may be selected for a particular job.

The invention provides a utility lamp which is modular in construction so that any broken or worn component of the utility lamp may be replaced without replacing the entire lamp.

There is also provided a utility lamp which includes an auxiliary base for supporting the lamp in an upright position above a work surface.

Thus, the invention provides a utility lamp having a pleasing asthetic appearance which makes its use in the home more likely. Since it may be disassembled and is not integrally formed with a power cord, it is easily stored in a drawer or closet for easy accessibility.

A preferred embodiment of the utility lamp in accordance with the invention comprises a handle having first and second ends, the first end including an electric lamp socket for accepting an electric light bulb and the second end including a pair of electric prongs for connection with an electric extension cord adapted for effecting an electrical connection between the electric prongs and a suitable power outlet, the electric prongs being in respective electrical connection with opposite poles of the socket to permit a transference of electric current from the extension cord to the bulb, and a power switch associated with the handle and operative selectively to enable and disable a flow of electric current from the prongs to the socket, and a protective cage connectable to the first end of the handle to surround and protect the light bulb from incidental contact with extraneous objects.

In accordance with the preferred embodiment of the invention, the utility lamp further includes a base having a top with a hole for receiving the second end of the handle in releasable locking engagement with that end of the handle to support the utility lamp in a substantially upright position with respect to the top of the base. The base further including legs which depend from the top to support the base on any substantially level surface. The top-of-the base is preferably, but not necessarily, triangular in shape and includes three legs which are mounted to the base by a pivot that permits each leg to be folded upwards against the base so that it occupies a minimum of space when it is not in use. The legs may be further divided into two sections which are likewise pivotally interconnected to permit a lower section of each leg to be folded upwardly into a channel formed by the upper section of each leg so that the folded legs may rest against an underside of the top of the base, ensuring that the base occupies minimal space when not in use.

The lamp is also carefully proportioned and designed to be asthetically pleasing and suitable for use in lighting areas other than garages and the like where utility lamps are currently commonly used because they tend to be bulky and awkward to store and use because of the attached power cord. The device of this invention, could have a shade associated with it, whereby it could function as a room lamp on a permanent or temporary basis.

The lamp may be constructed of suitable material dependent upon its proposed use. Thus it may be made from plastic material, metal or wood or combinations of these materials.

The base for this lamp could have other purposes than those proposed specifically for the lamp of this invention. In particular, it could be reinforced and strengthened such that it could function to support heavier objects, such as, for example potted plants, or it could be used as a stowable, portable footstool or stool for sitting upon. In the latter applications, the top or seat could be solid as opposed to being provided with an opening. Locking means would also preferably be associated with the legs to avoid accidental collapse underload.

BRIEF DESCRIPTION OF THE DRAWINGS

These and other features of the invention will be further explained in a detailed description of a preferred embodiment of the invention which is described by way of example only and with reference to the following drawings wherein.

DETAILED DESCRIPTION OF A PREFERRED EMBODIMENT

Figure 1:
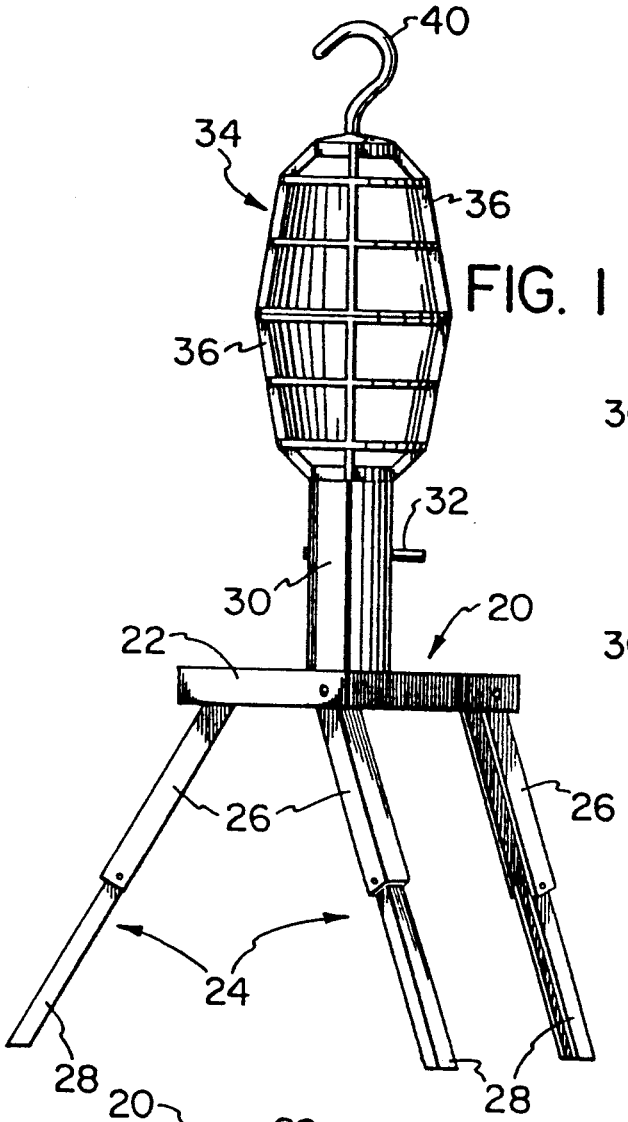
FIG. 1 is a front elevational view of a utility lamp in accordance with the invention, including a base for supporting the lamp in an upright position above a work surface.
Figure 2:
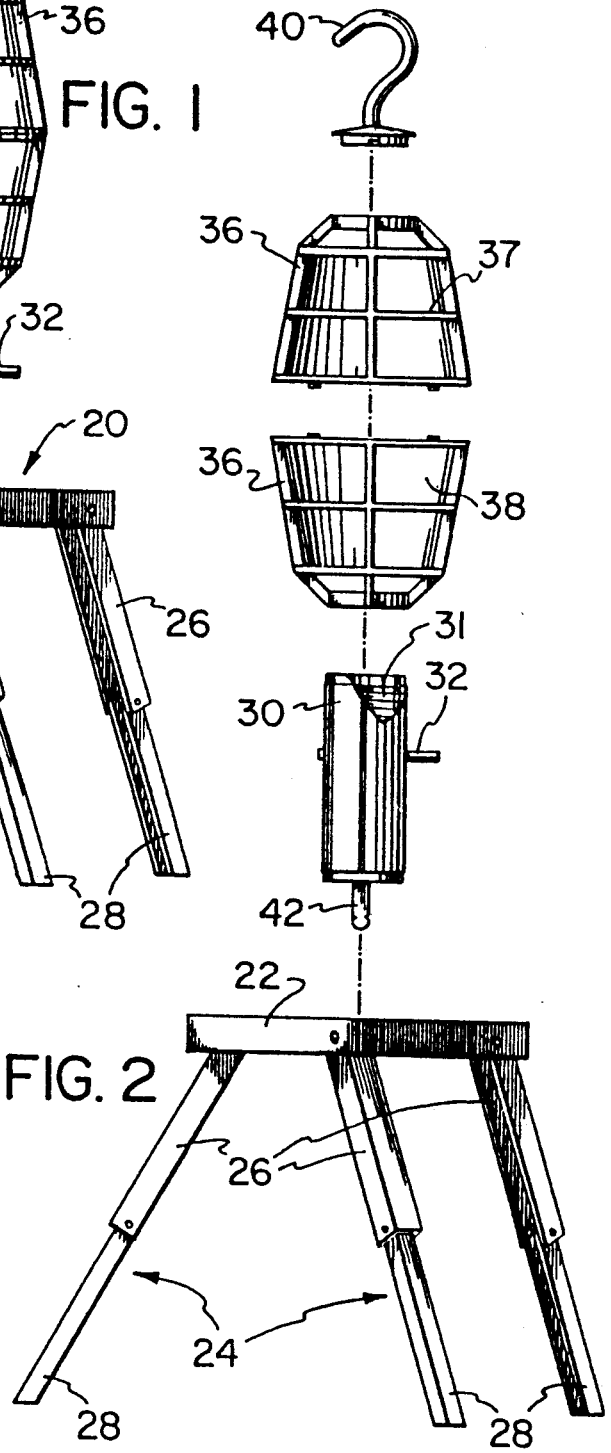
FIG. 2 is an exploded view of a utility lamp in accordance with the invention showing the various components of the lamp.

As shown in FIGS. 1 and 2 of the drawings, a preferred embodiment of the utility lamp in accordance with the invention includes a base, generally referred to by reference 20, a handle 30 and a protective cage, generally referred by reference 34, for surrounding and protecting a light bulb which is screwed into a socket 31 (see FIG. 2) in a top end of the handle 30, in a manner well known in the art.

Figure 3:
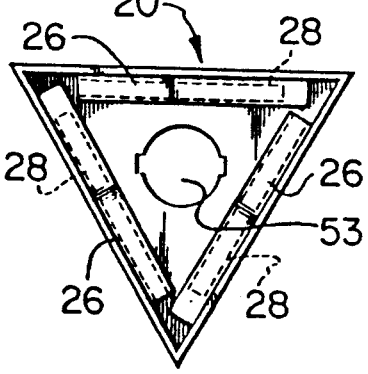
FIG. 3 is a bottom plan view of the base of the lamp with the legs in a folded condition.

A lamp base 20 in accordance with the invention includes a top 22 and legs generally referred to by reference 24 which depend from the corners of the top. Each leg preferably includes an upper section 26 and a lower section 28. The upper and lower sections are pivotally interconnected so that lower sections 28 may be folded upwardly into a hollow channel of upper sections 26. The legs are preferably likewise pivotally connected to the top 22 so that the folded legs may be rotated upwardly to lie flat against an inner surface of the top as shown in bottom plan view of FIG. 3. This provides a base 20 which occupies a minimum of storage space for convenient handling, packaging, marketing, and storage when not in use.

The handle 30 of the utility lamp is preferably cylindrical and includes an electrical socket 31 in its top end for receiving an electric light bulb. The handle further includes a pair of electric prongs 42 which project from its opposite end. The electric prongs 42 are in electrical connection (not illustrated) with opposite poles of the electric socket, in a manner well known in the art. A radial slide switch 32 permits the selective enabling or disabling of a flow of electrical current between the electric prongs 42 and the electric socket 31, in a manner well known in the art. There are, of course, many other switch arrangements which could be used for the same purpose. A linear slide switch, a rocker type switch and a twist stem type switch are just three examples of alternate switch arrangements which could be used.

The protective cage for an electric light bulb screwed into the socket 31 comprises an upper section 36 and a lower section 36, which sections are identical in construction and completely interchangeable. The upper and lower sections 36 have a front side which is an open grill 37 to permit the substantially unobstructed passage of illumination provided by an electric bulb screwed into the socket 31, and a back side 38 which comprises a substantially solid shield to protect the eyes of a user when the utility lamp is placed between the user and a work area being illuminated. This shield reflects light from the bulb and provides more intense illumination. The utility lamp further preferably includes a removable hook 40 which is affixed to an end of the protective cage by a twist lock connection which will be explained in more detail with reference to FIG. 6.

Figure 4:
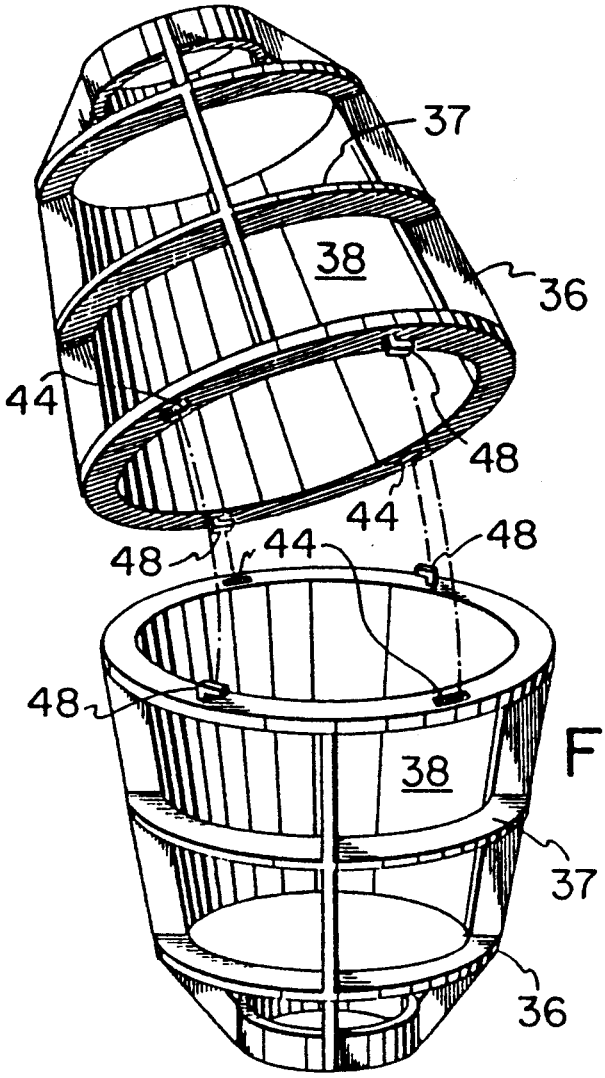
FIG. 4 is a detailed perspective view of the protective cage of the lamp showing a preferred connector arrangement for interconnecting the top and bottom sections of the protective cage.

As shown in FIG. 4, the upper and lower sections 36 of protective cage 34 are preferably interconnected by a twist-lock connection which includes upstanding L-shaped legs 48 and opposed rectangular slots 44. The legs 48 are pushed through slots 44 and a slight counter rotation of the two parts locks them together. This two part protective cage facilitates the insertion and removal of an electric light bulb in the utility lamp since the entire top end of the bulb is free to be gripped and rotated 360° for threading or unthreading the bulb in the socket in the top of the handle 30. Prior art utility lamps usually include a cage having a door that permits access to only one side of a bulb in the lamp socket. This makes servicing of the bulb awkward since the bulb can only be rotated a partial revolution before the fingers contact a side of the door. This problem is completely eliminated with the utility lamp in accordance with the invention.

Figure 5:
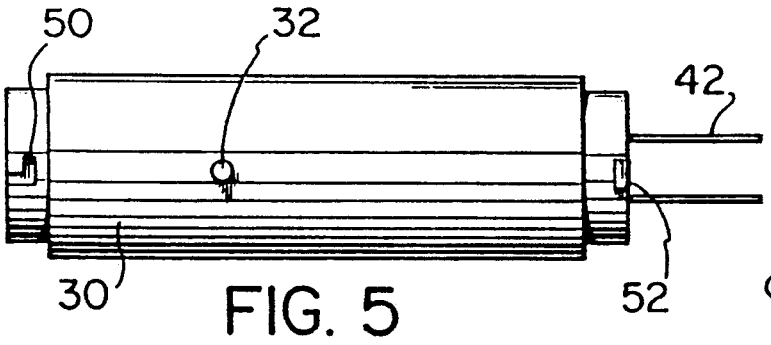
FIG. 5 is a side elevational view of the a preferred handle for the utility lamp in accordance with the invention.

FIG. 5 shows a detailed side elevational view of the handle of the utility lamp in accordance with the invention. In particular, the twist-lock connection between the bulb cage 34 and the handle 30 may be seen on the left hand end of FIG. 5. The twist-lock connection includes a pair of opposed L-shaped grooves 50 and a pair of complementary bosses (not illustrated) on the bulb cage 34 which are slidingly received in the L-shaped grooves 50 and lock the bulb cage to the handle when the handle is rotated in a clockwise direction. The opposite end of handle 30 locks to the lamp base 20 (see FIG. 3). An opening 53 in the lamp base 20 includes opposed peripheral notches which receive a projecting rectangular boss 52 on the right hand end of the handle 30.

Figure 6:
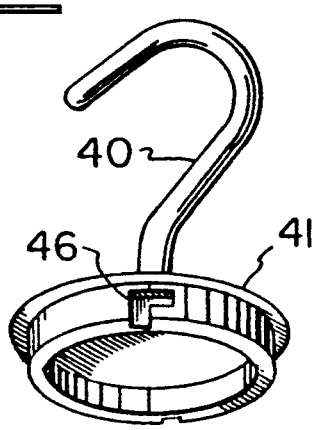
FIG. 6 is a side elevational view of a preferred hook for the utility lamp.

FIG. 6 is a detailed view of a preferred embodiment of the hook 40 in accordance with the invention. The hook preferably includes a twist-lock connection with a top end of the bulb cage 34. Alternatively the hook 40 may be fixed but still swivel. This connection is exactly as described for the top end of the handle 30 wherein opposed bosses (not illustrated) in an opening at the top of the bulb cage engage L-shaped grooves 46 in a base 41 of the hook and lock the hook to the bulb cage when the base 41 of the hook is rotated in a clockwise direction. The hook 40 is preferably rotatably affixed to the base 41 of the hook. A rotatable attachment of the hook permits the utility lamp to be rotated about the axis of the hook while the lamp is suspended from a support.

Figure 7:
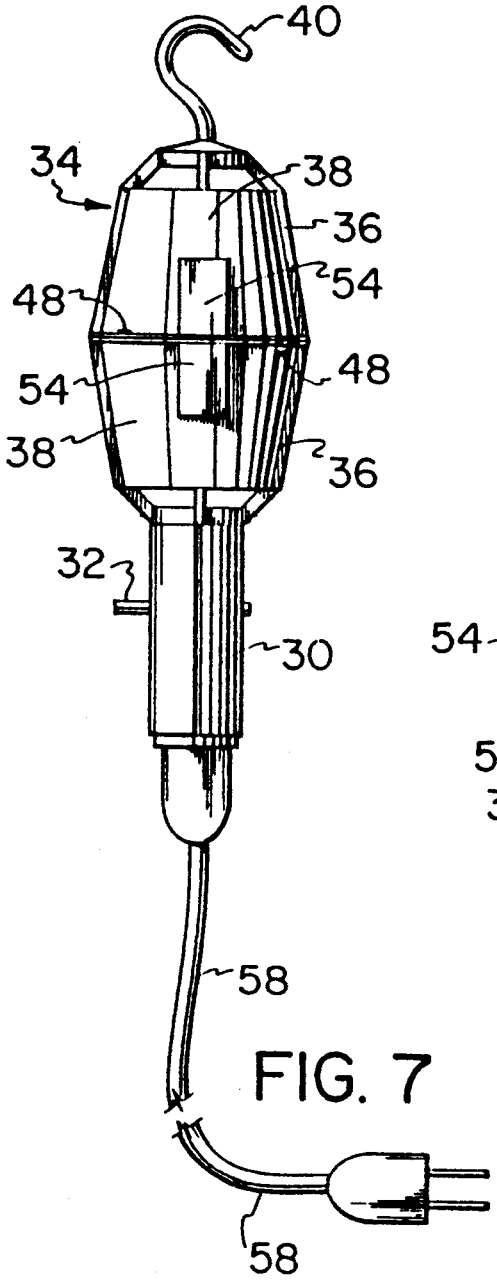
FIG. 7 is a rear elevational view of the utility lamp showing the lamp connected to an extension cord.
Figure 8:
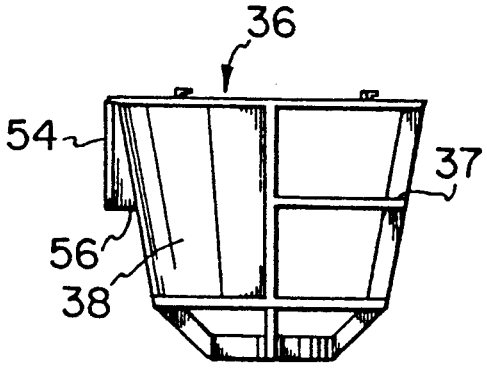
FIG. 8 is a side elevational view of one half of the bulb cage for the utility lamp showing the configuration of a flat plate on the back side of the protective cage.

FIGS. 7 and 8 illustrate a further feature of the invention. As noted above, the protective cage for the lamp includes an open grill 37 on its front side and a solid reflector 38 on its back side. The rear surface of each reflector 38 is further provided with a flat rectangular plate 54 which is mounted to that surface by a wedge-shaped connector 56 so that the plate is substantially parallel with an axis of the bulb cage 34. The two flat plates 54 serve a dual function. First, they provide a stable bearing to prevent the lamp from rolling sideways when it is laid face up on a substantially flat surface. Second, the flat plates 54 provide a surface for adhesively or mechanically attaching a magnet which may be used to suspend the lamp from any surface to which the magnet will adhere if no support suitable for the hook 40 is available in an area to be illuminated. Alternatively, flat plates 54 may be magnetic metal or ceramic plates which are affixed to the wedge-shaped connector 56 with glue, mechanical fasteners or the like.

As shown in FIG. 7, the electric prongs 42 (see FIG. 5) of the handle 30 may be connected to any extension cord 58 (see FIG. 7) which is in turn plugged into any suitable electrical outlet. Thus, the extension cord 58 ray be selected in accordance the requirements of a particular application and the length of the cord need not be predetermined as is the case with other utility-lamps currently available.

In use, a first section of bulb cage 36 is attached to a top end of the handle 30 and an appropriate light bulb (not illustrated) is screwed into the socket 31 provided in the top end of the handle 30. The top section of the bulb cage 34 is then twist-locked into place to protectively surround the light bulb. A suitable extension cord 58 is selected and connected to the electric prongs 42 on the lower end of the handle 30. The extension cord is then connected to a suitable wall outlet and the light bulb is turned on using switch 32. The lamp may be suspended by locking the handle to the base 20 (see FIG. 1), by suspending the lamp from hook 40, or by suspending the lamp from an appropriate surface using magnet 54 on the back side of the bulb shield 38.

Because the lamp is carefully proportioned to be aesthetically pleasing, it may be used in almost any situation where portable or temporary lighting is required. Thus a versatile lamp which is adapted to and suitable for a wide variety of uses is provided.

Changes and modifications to the specific embodiment of the invention hereinbefore described may be made without departing from the scope of the invention which is intended to be limited solely by the appended claims.

I claim:

1. A utility lamp, comprising:

a handle having first and second ends and including an electric lamp socket on the first end for accepting an electric light bulb and a pair of electric prongs on the second end for connection with an electric extension cord adapted for effecting an electrical connection between the electric prongs and a suitable power outlet, the electric prongs being in respective electrical connection with opposite poles of the lamp socket to permit the transfer of electric current from the extension cord to the bulb, and a power switch associated with the handle and operative selectively to enable and disable a flow of electric current from the electric prongs to the bulb;

a protective cage connectable with the first end of the handle to surround and protect the light bulb from incidental contact with extraneous objects; and a base for supporting the lamp in an upright orientation on a substantially lever surface to permit hands free illumination of a work area, the base including a top having an opening for receiving the second end of the handle in a releasable locking engagement and legs which depend from the top to support the top in parallel relation with the surface.

2. A utility lamp as claimed in claim 1 wherein the protective cage further includes a hook affixed to the cage to permit the utility lamp to be suspended from a supporting surface for hands free illumination of a work area.

3. A utility lamp as claimed in claim 2 wherein the hook is rotatable about its attachment to permit the lamp to be rotated about an axis of the hook.

4. A utility lamp as claimed in claim 3 wherein the protective cage comprises a lower cage part and an upper cage part which are detachably interconnected to permit the protective cage to be disassembled for removing and replacing the light bulb.

5. A utility lamp as claimed in claim 1 wherein the legs are respectively movable about a pivot affixed to the top so that the legs may be moved from a first extended position for supporting the top to a second folded position substantially parallel with the top so that the base may be stored efficiently when the legs are folded.

6. The utility lamp as claimed in claim 5 wherein the legs comprise at least two sections which are pivotally connected so that a first of the at least two sections is pivotable from an extended position in an axial alignment with a second of the at least two sections to a folded position parallel with the second of the at least two sections, and when the first of the at least two sections is folded the second of the at least two sections may be folded against the top so that the base occupies minimal space to provide for efficient storage when the base is not in use.

7. A utility lamp as claimed in claim 6 wherein the top of the base is triangular and the base includes three legs.

8. A utility lamp as claimed in claim 1 wherein the protective cage includes a front side comprising an open grill to permit substantially unobstructed passage of illumination provided by the light bulb while protecting the bulb from incidental contact with extraneous objects, and a back side comprising a substantially solid shield for protecting the eyes of a user from a direct glare from the light bulb when the utility lamp is placed between the user and a work area being illuminated.

9. The utility lamp as claimed in claim 8 wherein the back side of the protective cage further includes at least one plate having a flat side, the plate being affixed to the protective cage so that the flat side of the plate faces outwards and is substantially parallel with a longitudinal axis of the protective shield the plate providing a stable bearing to prevent the lamp from rolling sideways when laid face up on a substantially flat surface.

10. The utility lamp as claimed in claim 9 wherein the plate is magnetic.

11. The utility lamp as claimed in claim 9 wherein a magnet is affixed to the plate with one of an adhesive and a mechanical fastener.

12. A utility lamp comprising, in combination:

a handle having first and second ends and including an electric lamp socket on the first end for accepting an electric light bulb and a pair of electric prongs on the second end for connection with an electric extension cord adapted for effecting an electrical connection between the electric prongs and a suitable power source, the electric prongs being in respective electrical connection with opposite poles of the lamp socket to permit a transference of electric current from the extension cord to the bulb, and a power switch associated with the handle and operative selectively to enable and disable a flow of electric current from the electric prongs to the bulb;

a protective cage connectable with the first end of the handle for surrounding and protecting the electric light bulb from incidental contact with extraneous objects, the protective cage including a front side and a backside, the front side being an open grill for substantially unobstructed passage of illumination provided by the electric bulb and the back side being a substantially solid shield to reflect light and to protect the eyes of a user from the glare of the electric bulb when the utility lamp is positioned between the user and a work area being illuminated, the protective cage further including a hook for suspending the utility lamp from a support; and a base for selectively supporting the lamp in an upright orientation on a work area to provide hands free illumination of the work area, the base including a top having an opening for receiving the second end of the handle in a temporary locking engagement and legs which depend from the top to support the top in a parallel relation with the work area.

13. The utility lamp as claimed in claim 12 wherein the base is triangular and has three legs.

14. The utility lamp as claimed in claim 13 wherein the leg are affixed to the top of the base by a pivot which permits the legs to swivel from a first position for supporting the top to a second position parallel with the top so that the base occupies minimal space during storage.

15. The utility lamp as recited in claims 1 or 12 wherein the handle and the protective cage comprise an electrically nonconductive synthetic plastic.

16. The utility lamp as recited in claim 12 wherein the handle and the protective cage comprise an electrically nonconductive synthetic plastic.

17. The utility lamp as claimed in claim 12 wherein the legs comprise at least two sections which are partially connected so that a first of the at least two sections is pivotable from an extended position in an axial alignment with a second of the at least two sections to a folded position parallel with the second of the at least two sections and when the first of the at least two sections is folded the second of the at least two sections may be folded against the top so that the base occupies minimal space to provide for efficient storage when the base is not in use.

18. A utility lamp as claimed in claim 17 wherein the top of the base is triangular and the base includes three legs.

* * * * *